US006722338B2

(12) United States Patent
Okano et al.

(10) Patent No.: US 6,722,338 B2
(45) Date of Patent: Apr. 20, 2004

(54) ENGINE FOR MOTORCYCLE

(75) Inventors: Shigetaro Okano, Saitama (JP); Syuichi Ochiai, Saitama (JP); Itoko Kobayashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/214,775

(22) Filed: Aug. 9, 2002

(65) Prior Publication Data

US 2003/0070649 A1 Apr. 17, 2003

(30) Foreign Application Priority Data

Sep. 10, 2001 (JP) ..... 2001-273598

(51) Int. Cl.[7] ..... F02B 77/00
(52) U.S. Cl. ..... 123/198; 123/195 C
(58) Field of Search ..... 123/198, 195 C

(56) References Cited

FOREIGN PATENT DOCUMENTS

JP 11082051 A 3/1999

JP 234562 A 8/2000

*Primary Examiner*—Noah P. Kamen
(74) *Attorney, Agent, or Firm*—Birch, Stewart, Kolasch & Birch, LLP

(57) ABSTRACT

An engine for a motorcycle having dummy covers for covering at least part of cylinder heads from the sides and overhead covers for covering at least part of head covers coupled to the cylinder heads from above and the sides. This configuration is provided in order to enhance the functional beauty of the engine wand to eliminate the need to provide specially shaped parts for cylinder heads, or the need provide a special surface treatment for the cylinder heads. At least one spot of dummy covers is fastened to an engine main unit including a cylinder head and a head cover with bolts. A plurality of engaging protrusions provided in overhead covers formed in a shape to cover the bolts are resiliently engaged with the engine main unit or the dummy covers so that the overhead covers are detachable or attachable.

22 Claims, 11 Drawing Sheets

FIG. 7
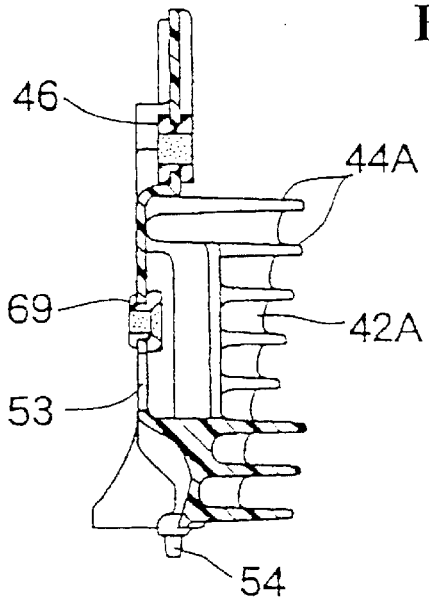
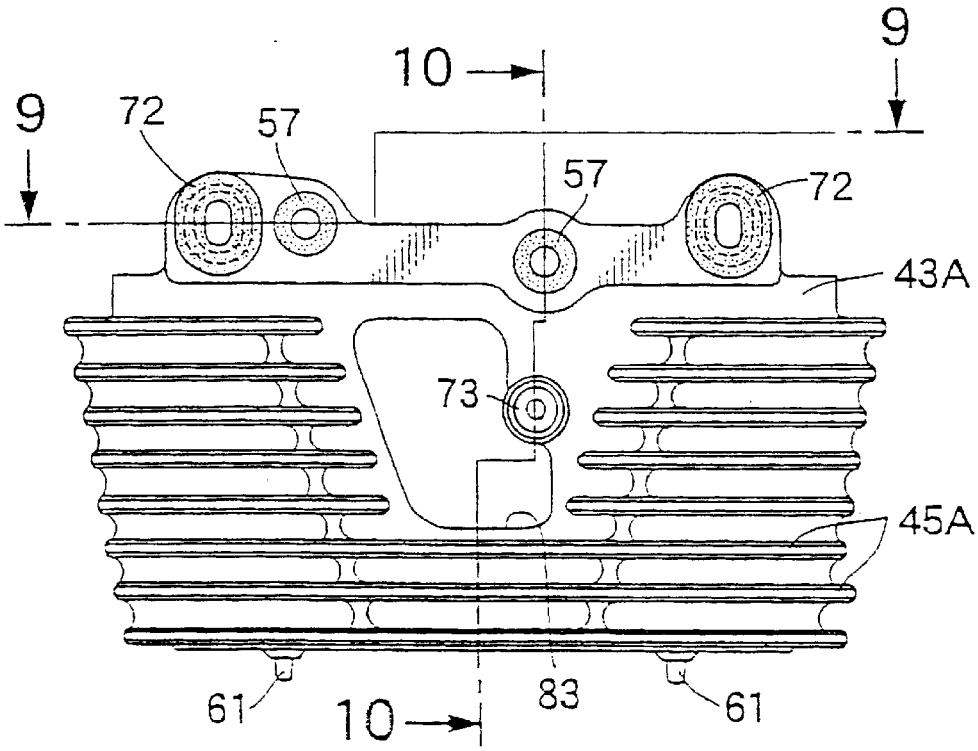
FIG. 8

FIG. 9
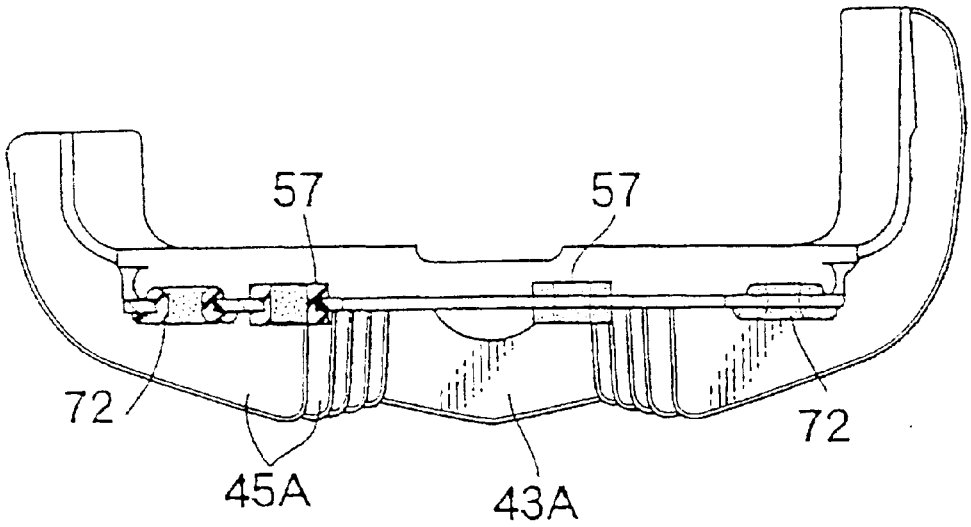
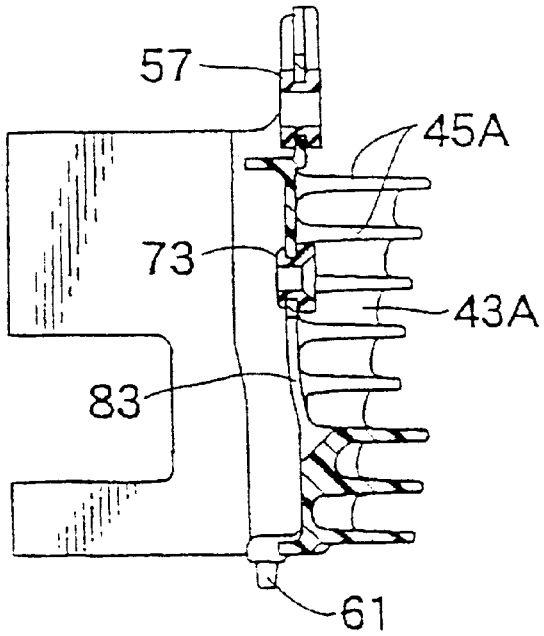
FIG. 10

FIG. 13
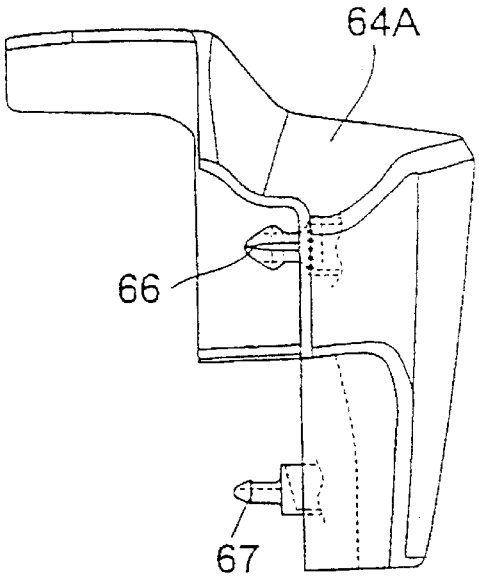
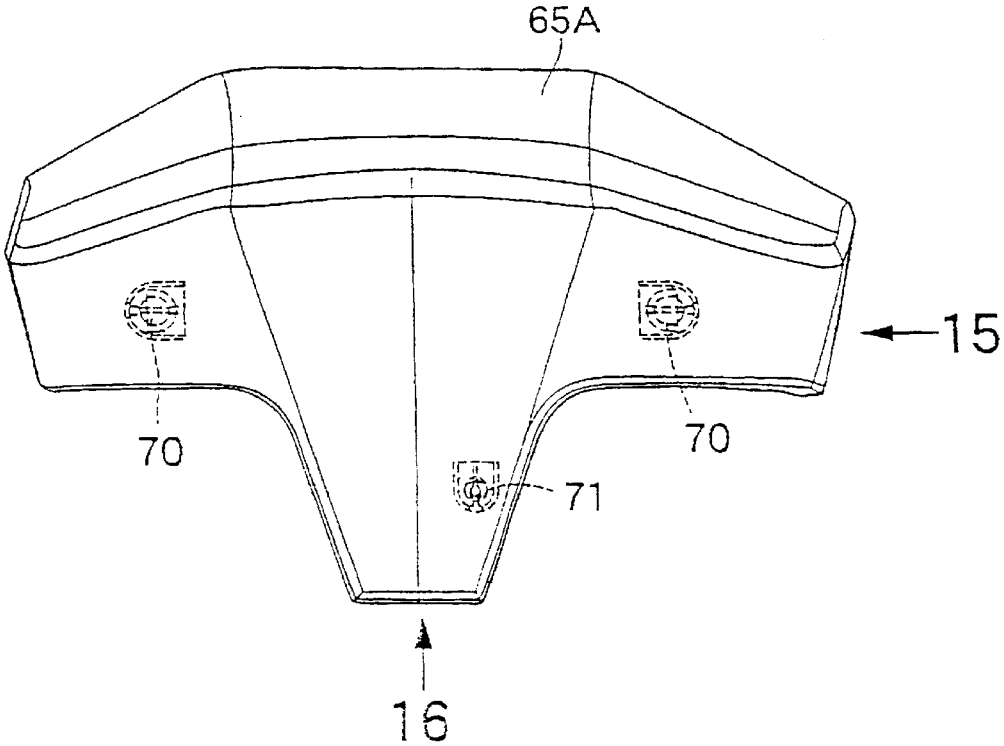
FIG. 14

FIG. 15
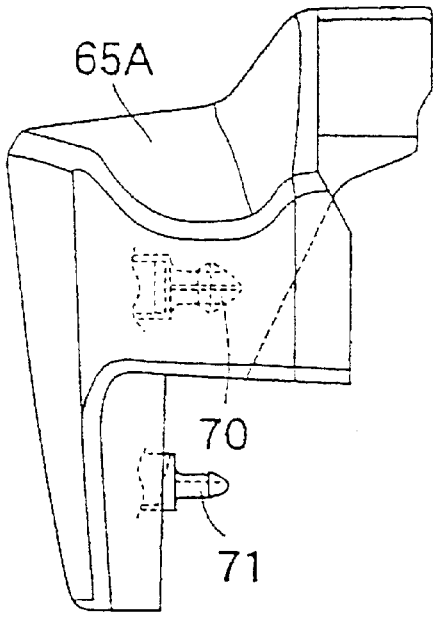
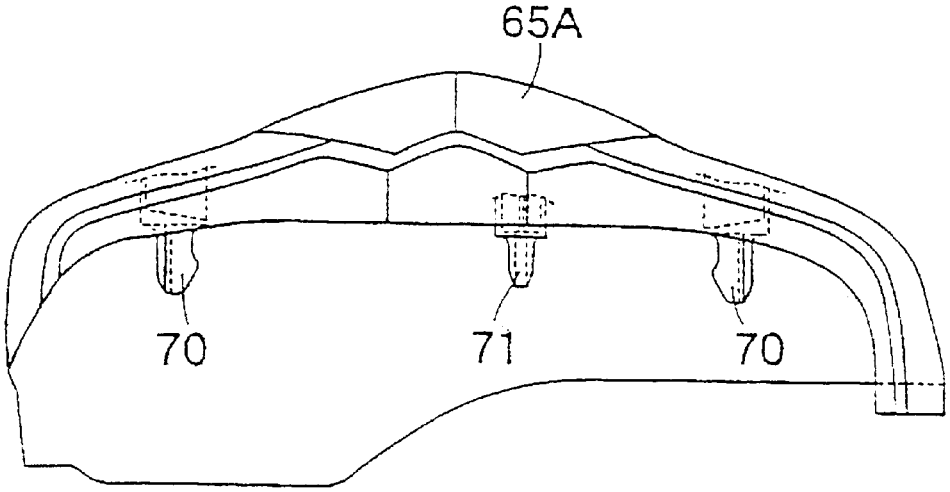
FIG. 16

ENGINE FOR MOTORCYCLE

CROSS-REFERENCE TO RELATED APPLICATION

The present application claims priority under 35 U.S.C. §119 to Japanese Patent Application No. 2001-273598, filed Sep. 10, 2001, the entire contents of are which hereby incorporated by reference.

BACKGROUND OF THE INVENTION

1. Field of the Invention

The present invention relates to an engine for a motorcycle having dummy covers for covering at least a part of cylinder heads from the sides, and overhead covers for covering from above and from the sides at least a part of head covers coupled to said cylinder heads.

2. Description of Background Art

Japanese Published Unexamined Patent Application No. 2000-234562 discloses a configuration in which head covers are at least partially covered from above and from the sides by overhead covers in order to enhance the functional beauty of a motorcycle engine and to improve noise proofing. In this configuration, protrusions provided in the head covers are engaged with the overhead covers, the overhead cover being fastened with bolts to the head covers. Bolt heads are arranged to face the outer surface of the overhead covers. Accordingly, the bolts are visible from the outside. To enhance their appearance, bolt heads having a special shape are employed, and an expensive surface treatment including chroming is performed on the bolt heads.

Japanese Published Unexamined Patent Application No. Hei 11-82051 discloses a configuration in which cylinder heads are at least partially covered from the sides by dummy covers having dummy cooling fins in order to enhance the functional beauty of a motorcycle engine. In this configuration, the dummy covers are snap-fit to stays on the cylinder heads and are fastened with bolts to a crankcase in order to increase vibration endurance. As in JP '562, the bolt heads are exposed to outside; and, in order to be aesthetically pleasing, special material and costly procedures must be employed.

SUMMARY AND OBJECTS OF THE INVENTION

The present invention was conceived in view of such circumstances. An object thereof is to provide dummy and overhead covers for a motorcycle engine which enhance functional beauty but require no specially shaped parts and no costly surface treatment.

To achieve this and other objects, the present invention provides a motorcycle engine having dummy covers for covering from the sides at least a part of cylinder heads, and overhead covers for covering from above and from the sides at least a part of head covers coupled to the cylinder heads. At least one spot of the dummy covers is fastened with bolts to an engine main unit housing the cylinder heads and head covers. A plurality of engaging protrusions disposed in the overhead covers so as to cover the bolts are resiliently engaged with the engine main unit or the dummy covers such that the overhead covers are detachable or attachable.

In the present invention, no specially shaped parts and no special surface treatment are required to enhance functional beauty. Frequently, side dummy covers are made of metal to eliminate heat and/or are provided with dummy cooling fins to enhance functional beauty. Strong support for the dummy covers is thus necessary. In still other configurations, the overhead covers require no dummy cooling, fins or are formed of a lightweight material, such as a synthetic resin. In these cases, it is not necessary to provide strong support for the overhead covers.

In the present invention, at least one spot of the dummy covers is fastened with bolts to the engine main unit, and a plurality of engaging protrusions provided in the overhead covers are resiliently engaged with the engine main unit or the dummy covers so that the overhead covers are detachable or attachable. Thus, the dummy covers and overhead covers can be supported in the engine main unit in any suitable configuration. The bolts for fastening at least one spot of the dummy covers to the engine main unit are covered by the overhead covers. Attractively shaped parts and expensive surface treatments, which would otherwise be required with exposed bolts, are, therefore, unnecessary. Accordingly, material costs can be reduced, while still providing an engine with enhanced functional beauty.

The dummy covers are provided with notches for arranging spark plugs mounted on the cylinder heads, and the overhead covers are formed in a shape to cover the notches from above. Thus, functional beauty can be enhanced. A plurality of engaging protrusions provided in the overhead covers are resiliently engaged with at least either of the cylinder heads and the head covers so as to be detachable or attachable. The overhead covers can be easily detached or attached, allowing maintenance of the spark plugs to be performed easily.

The cylinders of the engine main unit are coupled to the cylinder heads in portions corresponding to the fins closest to the cylinder heads of a plurality of fins provided in the sides of the cylinders aligned in the direction along cylinder axes of the cylinders. At least one recess is provided in the cylinders, and protrusions provided in the dummy covers fit into the recesses. According to this configuration, the dummy covers are supported by the cylinders in the engine main unit, together with fastening with bolts at least one spot thereof to the engine main unit. The dummy covers, which become relatively heavy, can be reliably fixed to the engine main unit. The mutual fitting portions of the dummy covers and the cylinders can be hidden by the fins provided in the cylinders. The mutual fitting of the dummy covers and the cylinders provides for functional beauty of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is a cross-sectional view taken along line 7—7 of FIG. 5;

FIG. 8 is a right side view of a left-side dummy cover;

FIG. 9 is a cross-sectional view taken along line 9—9 of FIG. 8;

FIG. 10 is a cross-sectional view taken along line 10—10 of FIG. 8.

FIG. 13 is a diagram of arrow 13 of FIG. 11;

FIG. 14 is a left side view of a left-side overhead cover;

FIG. 15 is a diagram of arrow 15 of FIG. 14;

FIG. 16 is a diagram of arrow 16 of FIG. 14; and

DETAILED DESCRIPTION OF THE PREFERRED EMBODIMENTS

In the following description, "left", "right", "front", "rear", "up" and "down" refer to the body of a motorcycle.

Figure 1:
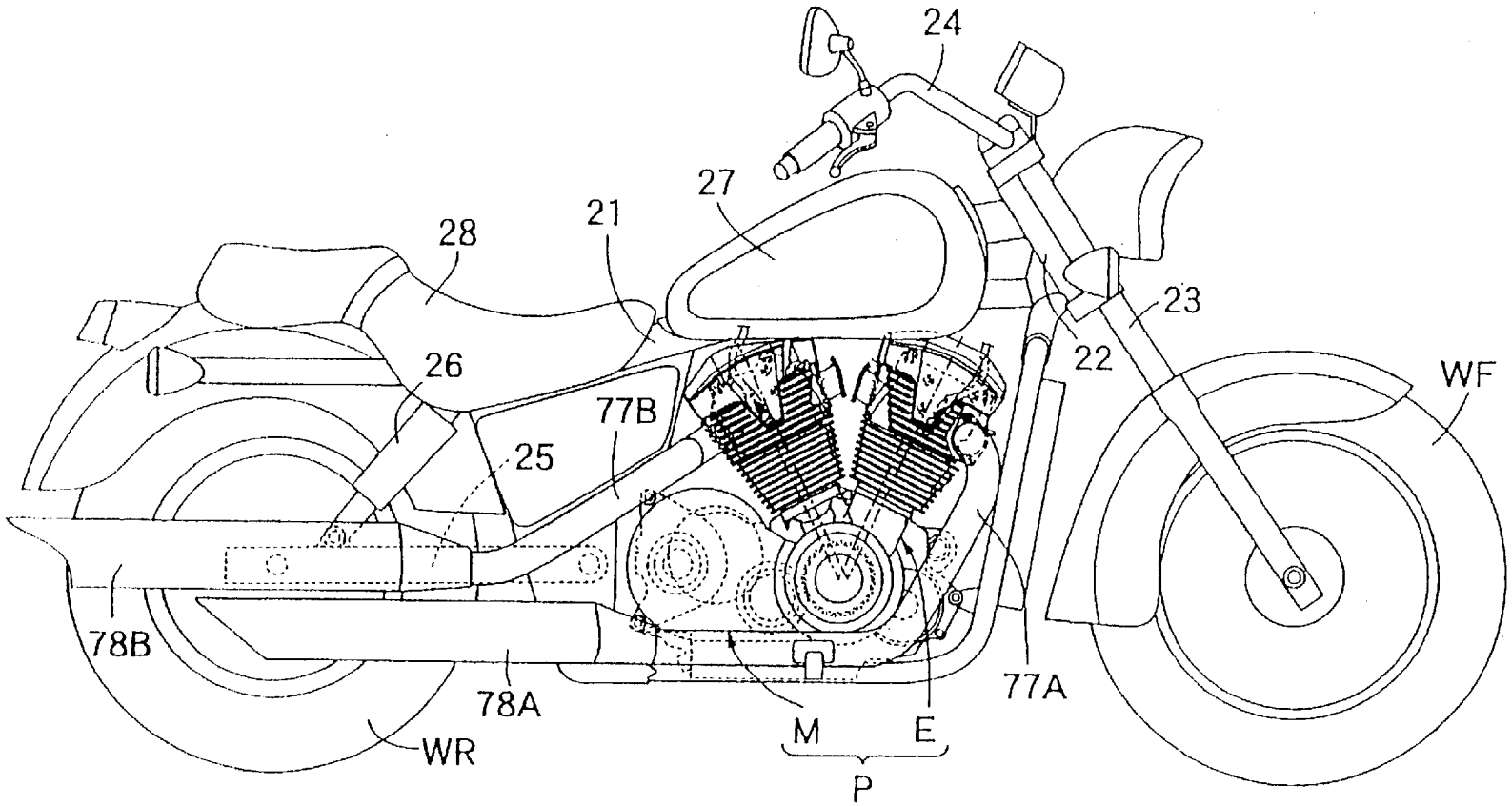
FIG. 1 is a right side view of a motorcycle.

In FIG. 1, in a head pipe 22 provided at the front end of a body frame 21 of a custom-type motorcycle, a front fork 23 for supporting a front wheel WF is steerably supported. An upper end of the front fork 23 is coupled to a steering wheel 24. A rear portion of the body frame 21 is coupled to a rear fork 25 for supporting a real wheel WR so as to be swingable upwards or downwards. A rear cushion 26 is interposed between the rear fork 25 and the body frame 21.

A fuel tank 27 is mounted on the body frame 21 rearwardly of the head pipe 22. A tandem-type riding seat 28 is provided on the body frame 21 rearwardly of the fuel tank 27.

A power unit P mounted on the body frame 21 is arranged below the fuel tank 27. The power unit P has a two-cylinder engine E and a transmission M for shifting the rotating power of the engine E, which is then transmitted to the rear wheel WR.

Figure 2:
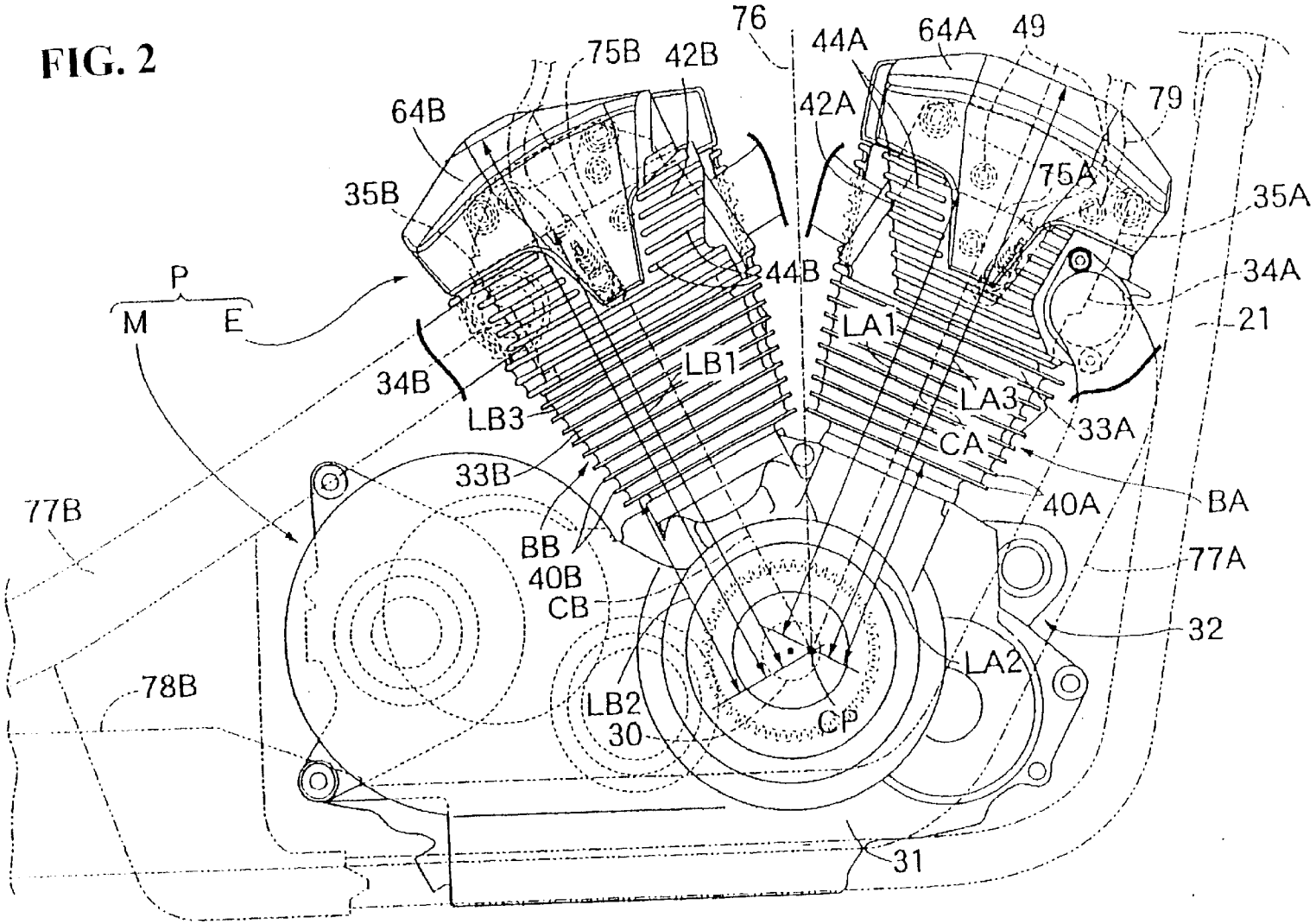
FIG. 2 is a side view of a power unit viewed from the right side of the motorcycle.
Figure 3:
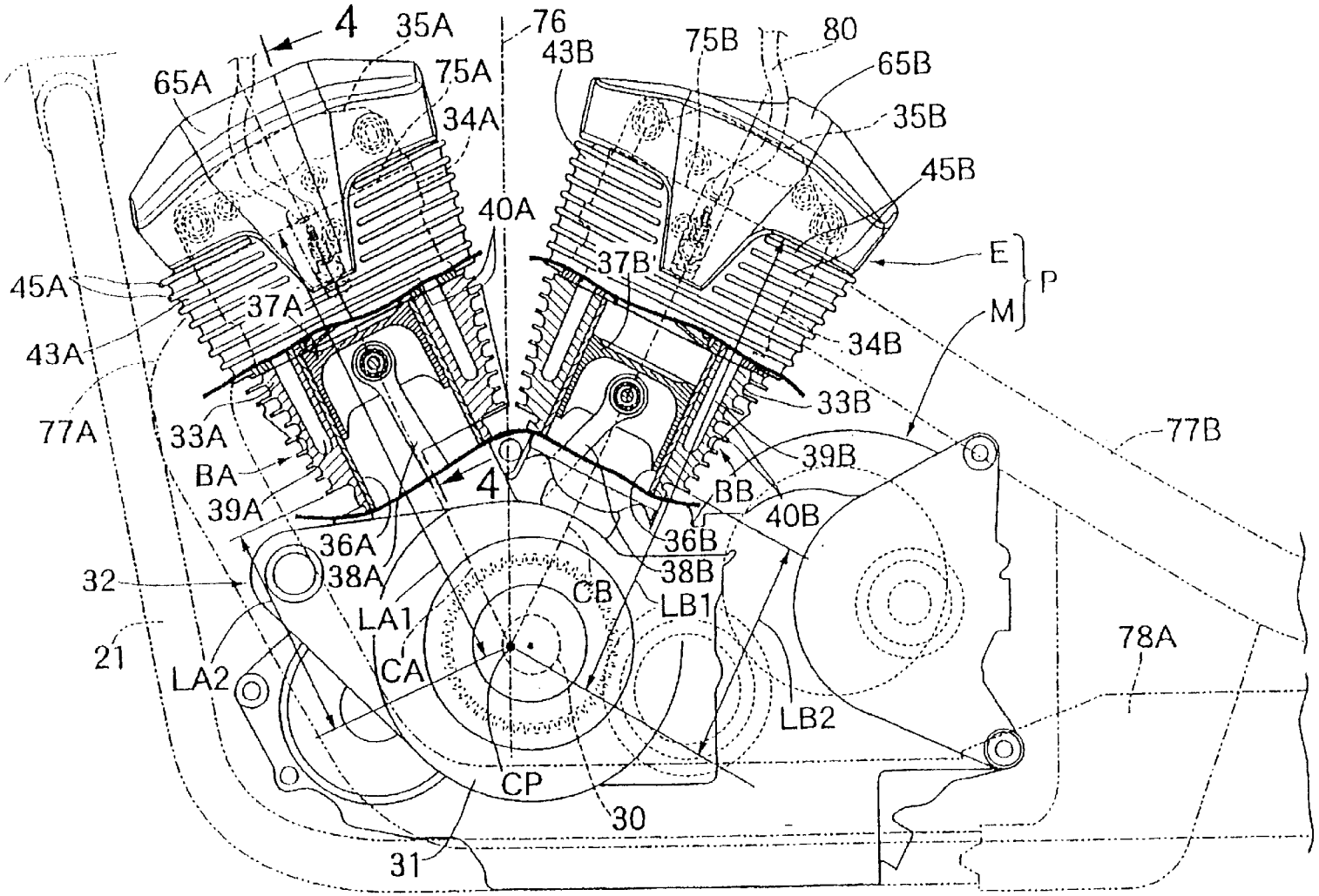
FIG. 3 is a partially cutaway longitudinal side view of the power unit viewed from the left side of the motorcycle.

Referring to FIGS. 2 and 3, the engine E is a V-type engine in which a first bank BA and a second bank BB disposed rearwardly of the first bank BA are arranged in a V shape in a plane orthogonal to the axis of a crankshaft 30 having an axis extending horizontally in the right and left directions of the body frame 21. The crankshaft 30 is rotatably supported in a crankcase 31, which serves as a transmission case for the transmission M.

The crankcase 31 is disposed in an engine main unit 32 of the engine E. A first cylinder 33A is coupled to the crankcase 31, and a second cylinder 33B is coupled to the crankcase 31 rearwardly of the first cylinder 33A. A first cylinder head 34A is coupled to the first cylinder 33A, and a second cylinder head 34B coupled to the second cylinder 33B. A first head cover 35A is coupled to the first cylinder head 34A, and a second head cover 35B is coupled to the second cylinder head 34B.

The first cylinder 33A and the first cylinder head 34A are coupled to each other in the first bank BA. The first cylinder 33B and the second cylinder head 34B are coupled to each other in the second bank BB. The second bank BB is arranged rearwardly of the first bank BA.

Pistons 37A, 37B, which are slidably fit into cylinder bores 36A, 36B, are provided in the first and second cylinders 33A, 33B and are coupled to the crankshaft 30 via connecting rods 38A, 38B.

The engine E is a water-cooled engine A first cooling water jacket 31A is formed in the first cylinder 33A and the first cylinder head 34A of the first bank BA. A second cooling water jacket 31B is formed in the second cylinder 33B and the second cylinder head 34B of the second bank BB. While the cooling fins normally required in an air-cooled engine need not be provided, to enhance the functional beauty of the engine E, a plurality of fins 40A is provided in the sides of the first cylinder 33A, aligned in the direction along a cylinder axis CA of the first cylinder 33A. A plurality of fins 40B equal in number to the fins 40A is provided in the second cylinder 33B, aligned in the direction along a cylinder axis CB of the second cylinder 33B.

Figure 4:
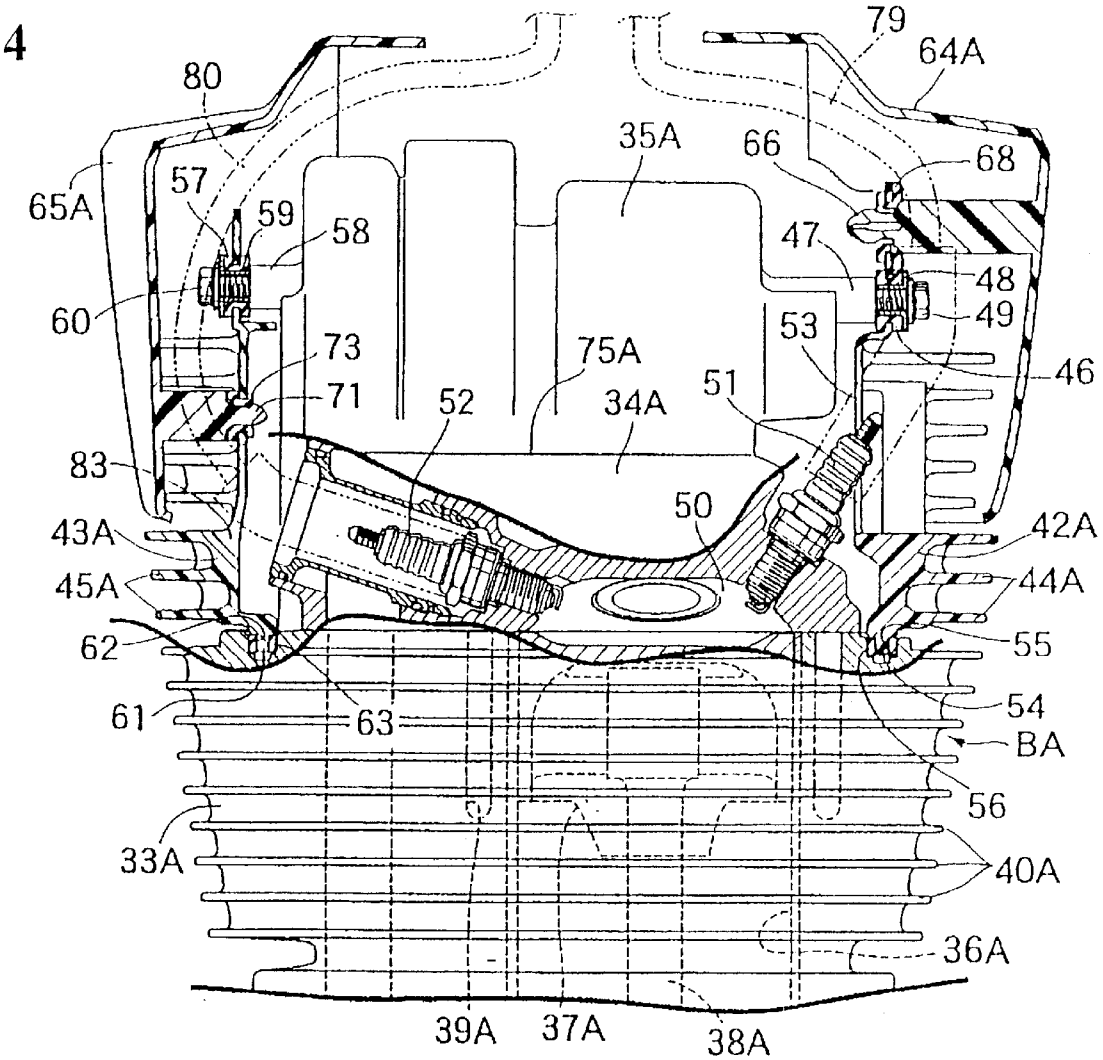
FIG. 4 is an enlarged cross-sectional view taken along line 4—4 of FIG. 3.

Referring to FIG. 4, the right sides of the first cylinder head 34A and the first head cover 35A are covered by a right-side first dummy cover 42A. The left sides of the first cylinder head 34A and the first head cover 35A are covered by a left-side first dummy cover 43A. These dummy covers 42A, 43A are intended to enhance functional beauty of the engine E, and are made of metal to eliminate heat and to enhance the functional beauty. An equal plurality of fins 44A, 45A which serve as dummy cooling fins are provided in the sides of the dummy covers 42A, 43A, respectively.

Figure 5:
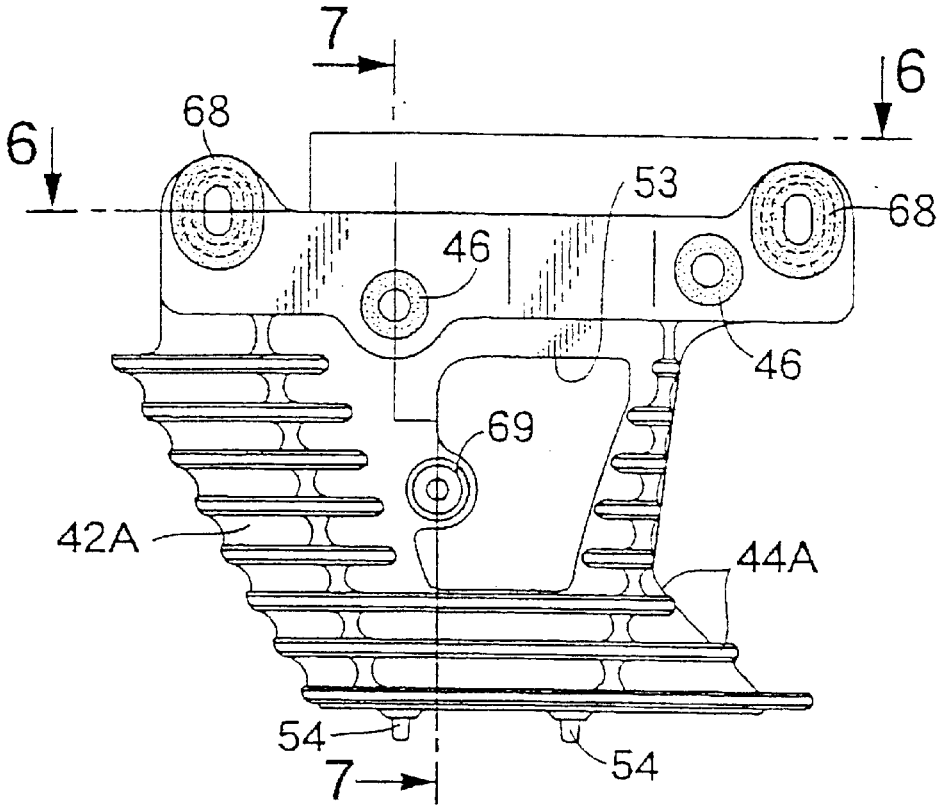
FIG. 5 is a left side view of a right-side dummy cover.
Figure 6:
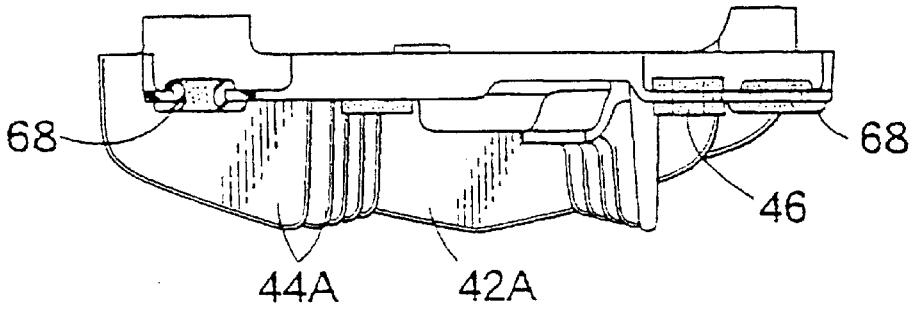
FIG. 6 is a cross-sectional view taken along line 6—6 of FIG. 5.

In FIGS. 5–7, at least one cylindrical resilient member 46 (a pair of cylindrical resilient members 46, 46 in this embodiment) is provided in the upper portion of the right-side first dummy cover 42A. Bosses 47 corresponding to the resilient members 46, 46 protrude into the right side of the first head cover 35A as part of the engine main unit 32. Bolts 41 extending through metal sleeves 48 inserted into the resilient members 46, 46 are threadably engaged with the bosses 47. At least one spot (two spots in this embodiment) of the right-side first dummy cover 42A is fastened to the first head cover 35A as part of the engine main unit 32 with the bolts 41.

On the first cylinder head 34A, a pair of spark plugs 51, 52 are mounted facing a combustion chamber 50. A notch 53 for arranging the one spark plug 51 is provided in the right-side first dummy cover 42A. The fins 44A avoid the notch 53 and are provided in the side of the right-side first dummy cover 42A.

At least one protrusion 54 (a pair of protrusions 54, 54 in this embodiment) protrudes in the lower portion of the right-side first dummy cover 42A. In the first cylinder 33A in a portion corresponding to the fin 40A closest to the first cylinder head 34A of the fins 40A in the first cylinder 33A, that is, the uppermost fin 40A, metal cylindrical members 56 are buried corresponding to the protrusions 54. The protrusions 54 fit into recesses 55 provided in the first cylinder 33A so as to be constructed by the cylindrical members 56 and the first cylinder 33A.

In FIGS. 8 to 10, at least one cylindrical resilient member 57 (a pair of cylindrical resilient members 57, 57 in this embodiment) is provided in the upper portion of the left-side first dummy cover 43A. Bosses 58 corresponding to the resilient members 57, 57 protrude into the left side of the first head cover 35A as part of the engine main unit 32. Bolts 60 extending through metal sleeves 51 inserted into the resilient members 57, 57 are threadably engaged with the bosses 58. At least one spot (two spots in this embodiment) of the left-side first dummy cover 43A is fastened with the bolts 60 to the first head cover 35A as part of the engine main unit 32.

A notch 83 for arranging the other spark plug 52 of the pair of spark plugs 51, 52 facing the combustion chamber 50 is provided in the left-side first dummy cover 43A. Fins 45A avoid the notch 83 and are provided in the side of the left-side first dummy cover 43A.

At least one protrusion 61 (a pair of protrusions 61, 61 in this embodiment) protrudes in the lower portion of the left-side first dummy cover 43A. Metal cylindrical members 63 corresponding to the protrusions 61 are buried in the first cylinder 33A in a portion corresponding to the fin 40A closest to the first cylinder head 34A. The protrusions 61 fit into recesses 62 provided in the first cylinder 33A so as to be constructed by the cylindrical members 63 and the first cylinder 33A.

At least part of the first head cover 35A coupled to the first cylinder head 34A (the right and left sides of the first head cover 35A in this embodiment) is covered by a right-side first overhead cover 64A and a left-side first overhead cover 65A.

Figure 11:
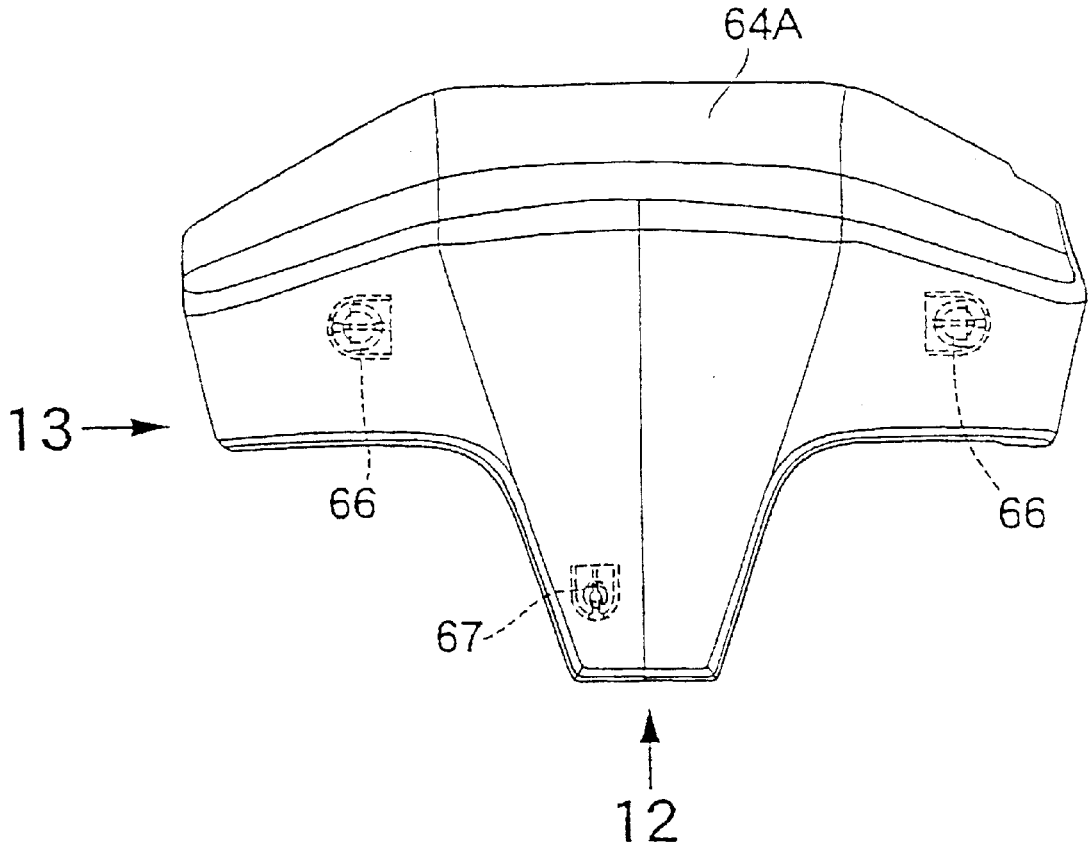
FIG. 11 is a right side view of a right-side overhead cover.
Figure 12:
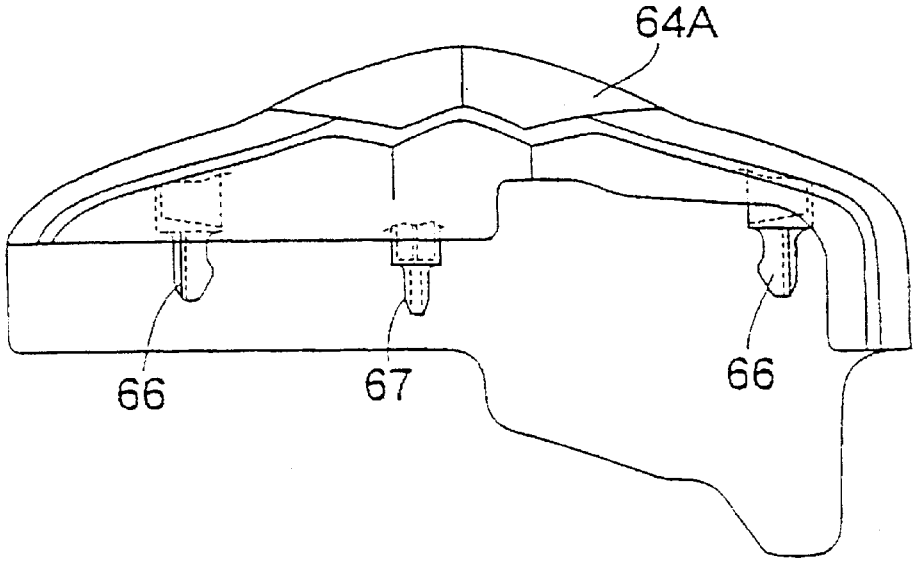
FIG. 12 is a diagram of arrow 12 of FIG. 11.

In FIGS. 11 to 13, the right-side first overhead cover 64A is formed of synthetic resin so as to cover the right side of the first head cover 35A from above and the sides and is mounted on the right-side first dummy cover 42A so as to be detachable or attachable.

When viewed from the side, the right-side first overhead cover 64A is seen to have a substantially T shape so as to cover the bolts 49 for mounting the right-side first dummy cover 42A on the first head cover 35A. The notch 53 is provided in the right-side first dummy cover 42A to accommodate the spark plug 51 when the right-side first dummy cover 42A is mounted.

A pair of engaging protrusions 66, 66 on the upper portion of the right-side first overhead cover 64A protrude into the right-side first dummy cover 42A side In the lower portion of the right-side first overhead cover 64A in the middle position between the engaging protrusions 66, 66, an engaging protrusion 67 protrudes to the right-side first dummy cover 42A side.

In the right-side first dummy cover 42A, cylindrical engaging members 68, 68 made of synthetic resin are provided corresponding to both the engaging protrusions 66, 66. A cylindrical engaging member 61 made of synthetic resin is provided corresponding to the engaging protrusion 67. The engaging protrusions 66, 66, 67 inserted into the engaging members 68, 68, 61 are resiliently engaged with the engaging members 68, 68, 61. The right-side first overhead cover 64A is supported in the right-side first dummy cover 42A by the resilient engagement permitting detachment or attachment.

The engaging member 61 is formed cylindrically. The engaging members 68, 68 are formed in a cylindrical shape having an ellipse cross-sectional shape which is long upwards and downwards. The upper portion of the right-side first overhead cover 64A in a state where the engaging protrusion 67 is resiliently engaged with an engaging member 69 is pressed to the right-side first dummy cover 42A side. The engaging protrusions 66, 66 can be easily resiliently engaged with the engaging members 68, 68. The right-side first overhead cover 64A can be easily mounted on the right-side first dummy cover 42A.

In FIGS. 14 to 16, the left-side first overhead cover 65A is formed of synthetic resin so as to cover the left side of the first head cover 35A from above and the sides, and is mounted on the left-side first dummy cover 43A so as to be detachable or attachable.

When viewed from the side, the left-side first overhead cover 65A is seen to have a substantially T shape, similar to the right-side first overhead cover 64A. As such, it covers the bolts 60 for mounting the left-side first dummy cover 43A on the first head cover 35A. The notch 83 is provided in the left-side first dummy cover 43A to accommodate the spark plug 52 when the left-side first dummy cover 43A is mounted.

In the upper portion of the left-side first overhead cover 65A, a pair of engaging protrusions 70, 70 protrude into the left-side first dummy cover 43A side. In the lower portion of the left-side first overhead cover 65A in the middle position between the engaging protrusions 70, 70, an engaging protrusion 71 protrude into the left-side first dummy cover 43A side.

In the left-side first dummy cover 43A, cylindrical engaging members 72. 72 made of synthetic resin are provided corresponding to both the engaging protrusions 70, 70. A cylindrical engaging member 73 made of synthetic resin is provided corresponding to the engaging protrusion 71. The engaging protrusions 70, 70, 71 inserted into the engaging members 72, 72, 73 are resiliently engaged with the engaging members 72, 72, 73. The left-side first overhead cover 65A is supported in the left-side first dummy cover 43A by the resilient engagement permitting detachment or attachment.

The engaging member 73 is formed cylindrically. The engaging members 72, 72 are formed in a cylindrical shape having an ellipse cross-sectional shape which is long upwards and downwards. When the engaging protrusion 71 is resiliently engaged with the engaging member 73, the upper portion of the left-side first overhead cover 65A presses into the left-side first dummy cover 43A side. The engaging protrusions 70, 70 can be easily resiliently engaged with the engaging members 72, 72. The left-side first overhead cover 65A can be easily mounted on the left-side first dummy cover 43A.

Again in FIGS. 2 and 3, the right side of the second cylinder head 34B of the second bank BB is covered by a right-side second dummy cover 42B. The left side of the second cylinder head 34B is covered by a left-side second dummy cover 43B thereof. These dummy covers 42B, 43B are intended for enhancing the functional beauty of the engine E, and are made of metal to eliminate heat and to enhance the functional beauty. An equal plurality of fins 44B, 45B as dummy cooling fins are provided in the sides of the dummy covers 42B, 43B, respectively.

At least one spot (two spots in this embodiment) of the dummy covers 42B. 43B is fastened to the second head cover 35B as part of the engine main unit 32 as in the dummy covers 42A, 43A or the first bank BA. The lower portions of the dummy covers 42B. 43B are fit into the upper portion of the second cylinder 33B, as in the dummy covers 42A. 43A of the first bank BA The right-side and left-side second dummy covers 42B, 43B are provided with the notches for arranging the spark plugs mounted on the second cylinder head 34B, as in the right-side and left-side first dummy covers 42A, 43A.

At least part of the second head cover 35B coupled to the second cylinder head 34B is covered by a right-side second overhead cover 64B and a left-side second overhead cover 65B.

The right-side second overhead cover 64B is formed of synthetic resin so as to cover the right side of the second head cover 35B from above and the sides, and is mounted on the right-side second dummy cover 42B so as to be detachable or attachable. The left-side second overhead cover 65B is formed of synthetic resin so as to cover the left side of the second head cover 35B from above and the sides, and is mounted on the left-side second dummy cover 43B so as to be detachable or attachable, as in a left-side second overhead cover 64B on the first bank BA side.

The right-side and left-side second overhead covers 64B, 65B have the side view formed in a substantially T shape so as to cover the fastening portion of the right-side and left-side second dummy covers 42B, 43B to the second head cover 35B. The right-side and left-side second overhead covers 64B, 65B cover the notches of the right-side and left-side second dummy covers 42B, 43B.

To reduce the nip angle of the first and second banks BA, BB, in a plane orthogonal to the axis of the crankshaft 30, a cross point CP of the cylinder axes CA, CB of both the banks BA, BB is arranged in the position forward of the axis of the crankshaft 30. In the plane, a length LA1 between a deck surface 75A of the first cylinder head 34A of the first bank BA and the cross point CP, and a length LB1 between a deck surface 75B of the second cylinder head 34B of the second bank BB and the cross point CP are different from each other. In other words, LA1<LB1.

The lengths LA1 and LB1 are different so that a difference in height between both the banks BA, BB is visually apparent. A feeling of unbalance may be produced, resulting in deterioration of the functional beauty of the engine E.

Figure 17:
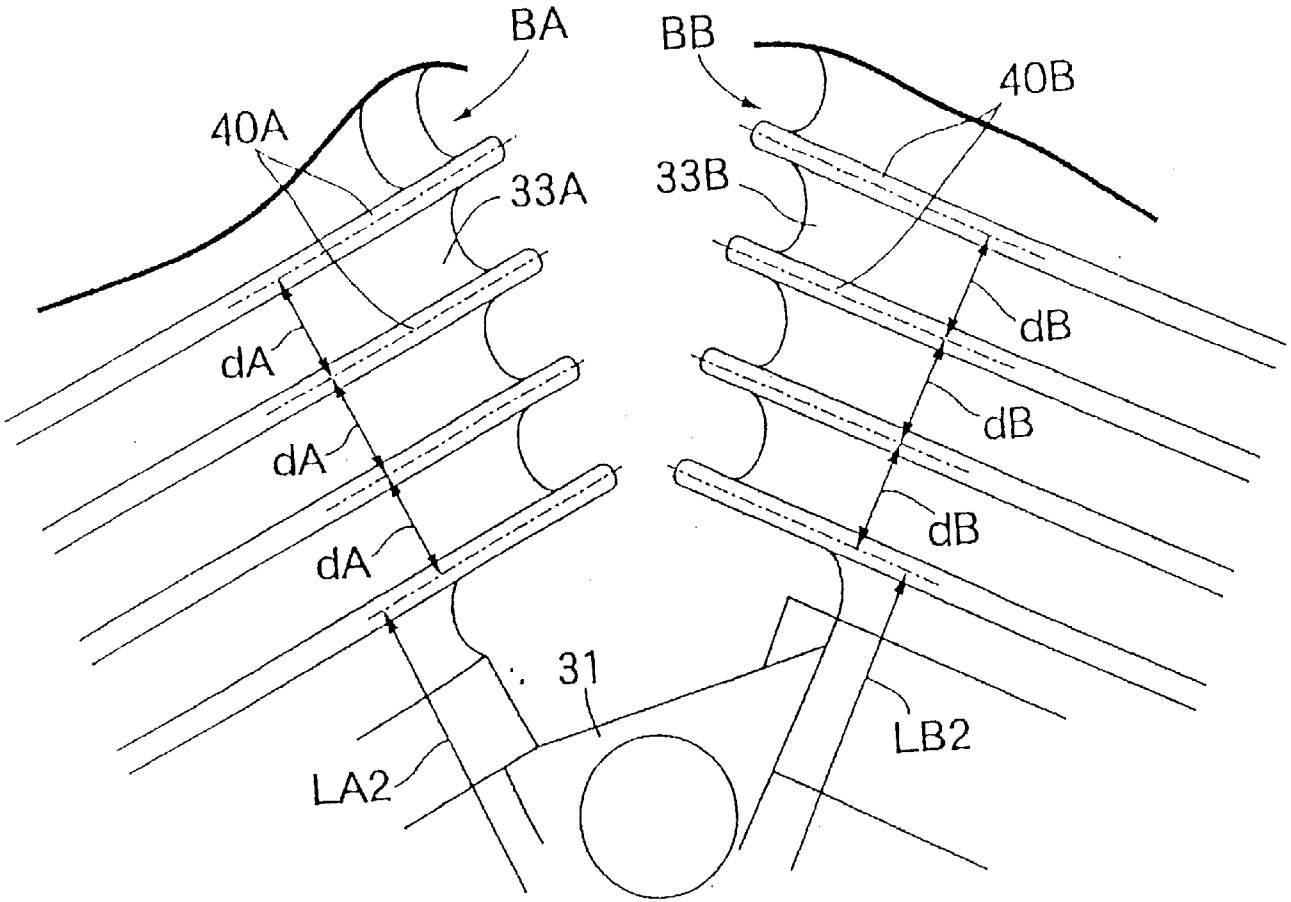
FIG. 17 is an enlarged side view of portions on a crankcase side of a first and a second cylinders viewed from the left side of the motorcycle.

The total numbers of a plurality of the fins 40A, 44A, 45A; 40B, 44B, 45B provided in the sides of the cylinders 33A, 33B of the first and second banks BA, BB and the sides of the dummy covers 42A, 43A; 42B, 43B for covering the head covers 34A, 34B coupled to the cylinders 33A, 33B from both the right and left sides set to be equal in the first and second banks BA, BB. A center line mutual distance dA of the fins 40A, 44A, 45A on the first bank BA side and a center line mutual distance dB of the fins 40, 44B, 45B on the second bank BB side are set to be almost equal, as shown in FIG. 17.

The lengths LA2, LB2 between the center lines of the fins 40A, 40B closest to the crankshaft 30 of the fins 40A, 44A, 45A; 40B, 44B, 45B and the cross point CP in the plane orthogonal to the axis of the crankshaft 30 are set to be almost equal in the first and second banks BA, BB.

In the side view in the direction along the axis of the crankshaft 30, the contour shapes of the first and second cylinders 33A, 33B including the fins 40A, 40B and the dummy covers 42A, 43A; 42B, 43B including the fins 44A, 45A; 44B, 45B are formed almost symmetrically with respect to a plane including a bisector 76 between both the banks BA, BB passing through the cross point CP in the plane orthogonal to the axis of the crankshaft 30.

A length LA3 is the distance between cross points at which the right-side and left-side first overhead covers 64A, 65A cross the cylinder axis CA of the first cylinder 33A in a plane orthogonal to the axis of the crankshaft 30 and the cross point CP at which the cylinder axes CA, CB cross each other in the plane. A length LB3 is the distance between a cross point at which the right-side and left-side second overhead covers 64B, 65B cross the cylinder axis CB of the second cylinder 33B in a plane orthogonal to the axis of the crankshaft 30 and the cross point CP at which the cylinder axes CA, CB cross each other in the plane. LA3 and LB3 are set to be almost equal to each other.

The front portion of the fist cylinder head 34A of the first bank BA is connected to the upstream end of an exhaust pipe 77A extended rearwardly on the right side of the body frame 21. The rear portion of the second cylinder head 34B of the second bank BB is connected to the upstream end of an exhaust pipe 77B formed to be bent on the right side of the body frame 21. Exhaust mufflers 78A, 78B arranged on the right side of the rear wheel WR are connected to the downstream ends of the exhaust pipes 77A, 77B. High tension cords 79, 80 continuous to the pair of spark plugs 51, 52 are mounted on each of the cylinder heads 34A, 34B of both the banks BA, BB and are drawn upward from between the right-side and left-side first overhead covers 64A, 65A and the right-side and left-side second overhead covers 64B, 65B.

Next, the operation of this embodiment will be described.

In the sides of the cylinders 33A, 33B of the first and second banks BA, BB and the sides of the dummy covers 42A, 43A; 42B, 43B for covering the head covers 34A, 34B from both the right and left sides, the plurality of fins 40A, 44A, 45A, 40B, 44B, 45B aligned in the direction along the cylinder axes CA, CB of the first and second cylinders 33A, 33B are provided so that the total numbers of the fins 40A, 44A, 45A; 40B, 44B, 45B and the center line mutual distances dA and dB of the fins 40A, 44A, 45A; 40B, 44B, 45B are almost equal in the first and second banks BA, BB.

The lengths LA2, LB2 between the center lines of the fins 40A, 40B closest to the crankshaft 30 of the fins 40A, 44A, 45A; 40B, 44B, 45B and the cross point CP in the plane orthogonal to the axis of the crankshaft 30 are set to be almost equal in the first and second banks BA, BB.

The fins 40A, 44A, 45A; 40B, 44B, 45B serve the function of enhancing the appearance of both the banks BA, BB. In the above-described configuration, the fins 40A, 44A, 45A; 40B, 44B, 45B in both the banks BA, BB are arranged corresponding to almost the same position along the cylinder axes CA, CB of the banks BA, BB. With this arrangement, a positive visual impression is obtained, since the heights of both the banks BA, BB appear to be the same. Thus, the functional beauty of the V-type engine E can be enhanced, and the marketability of the engine E can be improved.

In the side view in the direction along the axis of the crankshaft 30, the contour shapes of the first and second cylinders 33A, 33B including the fins 40A . . . , 40B and the dummy covers 42A, 43A; 42B, 43B including the fins 44A, 45A; 44B, 45B are formed almost symmetrically with respect to a plane including the bisector 76 between both the banks BA, BB passing through the cross point CP of the cylinder axes CA, CB of both the banks BA, BB. With this arrangement, the contours of the first and second banks BA, BB are nearly symmetrical to one another. As a result, the functional beauty of the V-type engine E can be enhanced and the marketability can be improved.

The lengths LA3, LB3 are set to be almost equal in both the banks BA, BB. With this arrangement, the height difference and the shape difference of both the banks BA, BB appear to be small. As a result, the functional beauty of the V-type engine E can be enhanced and the marketability can be improved.

In the banks BA, BB, the right-side and left-side first dummy covers 42A, 43A and the right-side and left-side second dummy covers 42B, 43B for covering the cylinder heads 34A, 34B from the right and left sides can be fastened to the head covers 35A, 35B in at least one or more spots.

The dummy covers 42A, 43A; 42B, 43B are provided with the fins 44A, 45A; 44B, 45B for enhancing the functional beauty, and are formed of metal, which both eliminates heat and enhances the functional beauty of the engine. Strong support is thus required. As described above, at least one spot of the dummy covers 42A, 43A; 42B, 43B is fastened to the engine main unit 32. As a result, the dummy covers 42A, 43A; 42B, 43B are supported strongly by the engine main unit 32

In many cases, the overhead covers 64A, 65A, 64B, 65B require no fins and are formed of synthetic resin as light-weight material, since requirements to eliminate heat and to enhance the functional beauty are relatively low. In this situation, the overhead covers 64A, 65A; 64B, 65B need not be supported very strongly.

The plurality of engaging protrusions 66, 67; 70, 71 provided in the overhead covers 64A, 65A; 64B, 65B are resiliently engaged with the dummy covers 42A, 43A; 42B, 43B so as to be detachable or attachable. The dummy covers 42A, 43A; 42B, 43B and the overhead covers 64A, 65A; 64B, 65B can be supported in the engine main unit 32 in any suitable configuration.

The bolts 49, 60 for fastening at least one spot of the dummy covers 42A, 43A; 42B, 43B to the engine main unit 32 are covered by the overhead covers 64A, 65A; 64B, 65B. Thus, specially shaped parts and special surface treatment for the exposed bolts 49, 60 are not necessary, thereby reducing costs while enhancing the functional beauty of the engine E.

The right-side first and second dummy covers 42A, 42B and the left-side first and second dummy covers 43A, 43B are provided with the notches 53, 83 for arranging the spark plugs 51, 52 mounted on the cylinder heads 34A, 34B. The right-side first and second overhead covers 64A, 65A and the left-side first and second overhead covers 64B, 65B are formed in a shape to cover the notches 53, 83 from above. The notches 53, 83 for arranging the spark plugs 51, 52 are covered by the overhead covers 64A, 65A, 64B, 65B from above. As a result, the functional beauty can be further enhanced.

The plurality of engaging protrusions 66, 66, 67, 70, 70, 71 provided in the overhead covers 64A, 64B, 65A, 65B are resiliently engaged with the dummy covers 42A, 42B, 43A, 43B so as to be detachable or attachable. With this arrangement, the overhead covers 64A, 65B, 65A, 65B can be easily detached or attached As a result, maintenance of the spark plugs 51, 52 can be performed easily.

At least one (two in this embodiment) recesses 55, 62 is provided in portions of cylinders 33A, 33B corresponding to the uppermost of the fins 40A, 40B provided in the sides of the cylinders 33A, 33B. The protrusions 54, 61 provided in the dummy covers 42A, 43A; 42B, 43B fit into the recesses 55, 62.

The dummy covers 42A, 43A; 42B, 43B are supported by the cylinders 33A, 33B of the engine main unit 32 together with fastening of at least one spot thereof to the engine main unit 32 with the bolts 49, 60. The dummy covers 42A, 43A; 42B, 43B, which become relatively very heavy, can be fixed reliably to the engine main unit 32. With this configuration, the mutual fitting portions of the dummy covers 42A, 43A; 42B, 43B and the cylinders 33A, 33B can be hidden by the fins 40A, 40B provided in the cylinders 33A, 33B. As a result, functional beauty of the engine E is achieved.

The V-type engine is described in the embodiment. However, the present invention is not limited to the V-type engine.

The effects of the invention are summarized below

As described above, engine parts of a special shape and requiring a surface treatment are unnecessary. The notches for arranging the spark plugs are covered by the overhead covers from above. Thus, functional beauty of the engine can be enhanced.

Also, the overhead covers can be easily detached or attached. Thus, maintaining the spark plugs can be accomplished easily.

Moreover, the dummy covers, which become relatively very heavy, can be fixed reliably to the engine main unit. The mutual fitting of the dummy covers and the cylinders are configured so as maintain the functional beauty of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine for a motorcycle comprising:

dummy covers for covering from the sides at least a part of cylinder heads, at least one spot of said dummy covers being fastened with bolts to an engine main unit housing said cylinder heads and head covers;

overhead covers for covering from above and from the sides at least a part of said head covers coupled to said cylinder heads; and a plurality of engaging protrusions provided in said overhead covers formed in a shape to cover said bolts, said engaging protrusions being resiliently engaged with said engine main unit or said dummy covers so that said overhead covers are detachable or attachable.

2. The engine for a motorcycle according to claim 1, further comprising notches in said dummy covers for arranging spark plugs mounted on the cylinder heads said overhead covers being formed in a shape to cover said notches from above.

3. The engine for a motorcycle according to claim 2, further comprising fins on said dummy covers, the fins being interrupted around said notches.

4. The engine for a motorcycle according to claim 1, further comprising:

cylinders of said engine main unit, the cylinders having a plurality of fins on outer sides thereof and aligned in the direction of cylinder axes, the cylinders being coupled to said cylinder heads at ends provided with said fins, and the cylinders having at least one recess; and protrusions provided in said dummy covers for fitting into said at least one recess of said cylinders.

5. The engine for a motorcycle according to claim 4, wherein said protrusions are disposed on lower sides of said dummy covers for coupling with said cylinders.

6. The engine for a motorcycle according to claim 1, wherein the at least one spot is formed as a resilient member.

7. The engine for a motorcycle according to claim 1, wherein said head covers are formed of a synthetic resin material.

8. The engine for a motorcycle according to claim 1, wherein said overhead covers are T-shaped.

9. The engine for a motorcycle according to claim 1, wherein the dummy covers are made of metal for eliminating heat.

10. An engine for a motorcycle comprising:

right dummy covers for covering from the sides at least a part of a right cylinder head;

left dummy covers for covering from the sides at least a part of a left cylinder head, at least one spot of said dummy covers being fastened with bolts to an engine main unit including said cylinder heads and head covers;

overhead covers for covering at least part of said head covers coupled to said cylinder heads from above and the sides; and a plurality of engaging protrusions provided in said overhead covers formed in a shape to cover said bolts, said engaging protrusions being resiliently engaged with said engine main unit or said dummy covers so that said overhead covers are detachable or attachable.

11. The engine for a motorcycle according to claim 10, further comprising notches in said dummy covers for arranging spark plugs mounted on the cylinder heads, said overhead covers being formed in a shape to cover said notches from above.

12. The engine for a motorcycle according to claim 11, further comprising fins on said dummy covers, the fins being interrupted around said notches.

13. The engine for a motorcycle according to claim 11, wherein said right dummy covers have shapes that are different from left side dummy covers.

14. The engine for a motorcycle according to claim 10, further comprising:

cylinders of said engine main unit, the cylinders having a plurality of fins on outer sides thereof and aligned in the direction of cylinder axes, the cylinders being coupled to said cylinder heads at ends provided with said fins, and further the cylinders having at least one recess; and protrusions provided in said dummy covers for fitting into said at least one recess of said cylinders.

15. The engine for a motorcycle according to claim 14, wherein said protrusions are disposed on lower sides of said dummy covers for coupling with said cylinders.

16. The engine for a motorcycle according to claim 10, wherein the at least one spot is formed as a resilient member.

17. The engine for a motorcycle according to claim 10, wherein said head covers are formed of a synthetic resin material.

18. The engine for a motorcycle according to claim 10, wherein said overhead covers are T-shaped.

19. The engine for a motorcycle according to claim 10, wherein the dummy covers are made of metal for eliminating heat.

20. An engine for a motorcycle having dummy covers for covering at least part of cylinder heads from the sides, and overhead covers for covering at least part of head covers coupled to said cylinder heads from above and the sides, wherein at least one spot of said dummy covers is fastened with bolts to an engine main unit including said cylinder heads and head covers, and a plurality of engaging protrusions provided in said overhead covers formed in a shape to cover said bolts are resiliently engaged with said engine main unit or dummy covers so as to be detachable or attachable.

21. The engine for a motorcycle according to claim 20, wherein said dummy covers are provided with notches for arranging spark plugs mounted on the cylinder heads, and said overhead covers are formed in a shape to cover said notches from above.

22. The engine for a motorcycle according to claim 20, wherein cylinders consisting of part of said engine main unit are coupled to said cylinder heads, in portions corresponding to the fins closest to the cylinder heads of a plurality of fins provided in the sides of the cylinders aligned in the direction along cylinder axes of said cylinders, at least one recess is provided in the cylinders, and protrusions provided in said dummy covers fit into said at least one recess.

* * * * *